US009148711B2

(12) United States Patent
Xu et al.

(10) Patent No.: US 9,148,711 B2
(45) Date of Patent: Sep. 29, 2015

(54) MICRO-SPEAKER

(71) Applicants: Yunxia Xu, Shenzhen (CN); Bin Cai, Shenzhen (CN)

(72) Inventors: Yunxia Xu, Shenzhen (CN); Bin Cai, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/527,917

(22) Filed: Oct. 30, 2014

(65) Prior Publication Data

US 2015/0201256 A1 Jul. 16, 2015

(30) Foreign Application Priority Data

Jan. 13, 2014 (CN) ..... 2014 2 0018907 U

(51) Int. Cl.
*H04R 1/02* (2006.01)
*H04R 1/00* (2006.01)
*H04R 7/04* (2006.01)

(52) U.S. Cl.
CPC ... *H04R 1/00* (2013.01); *H04R 7/04* (2013.01)

(58) Field of Classification Search
CPC ..... H04R 1/00; H04R 7/04; H04R 2499/11
USPC ..... 381/394, 400
See application file for complete search history.

(56) References Cited

U.S. PATENT DOCUMENTS

| | | | | |
|---|---|---|---|---|
| 2002/0071591 | A1* | 6/2002 | Han et al. | 381/412 |
| 2012/0170791 | A1* | 7/2012 | Meng | 381/386 |
| 2012/0170793 | A1* | 7/2012 | Jiang et al. | 381/412 |
| 2013/0016874 | A1* | 1/2013 | Huang et al. | 381/433 |
| 2013/0322679 | A1* | 12/2013 | Jiang et al. | 381/398 |

* cited by examiner

*Primary Examiner* — Tuan D Nguyen
(74) *Attorney, Agent, or Firm* — IPro, Inc.; Na Xu

(57) ABSTRACT

A micro-speaker is disclosed. The micro-speaker includes a frame, a magnetic circuit received in the frame, a voice coil partially received in the magnetic circuit, a diaphragm connected to the voice coil, and a contact fixed by the frame for electrically connecting the voice coil to an external circuit. The contact includes a base plate, a first and second connecting plates respectively connected to both ends of the base plate and formed an engaging space by connecting them in order. Corresponding to the contact, the frame includes a sidewall and a protrusion formed on the sidewall. The engaging space receives and engages with the sidewall and the second plating plate engages with the protrusion for mounting the contact on the frame firmly without soldering.

15 Claims, 5 Drawing Sheets

Fig.4

MICRO-SPEAKER

FIELD OF THE INVENTION

The present invention relates to electro-acoustic transducers, more particularly to a micro-speaker having elastic contacts for electrically connecting to an external circuit.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. With the mobile phone is designed to be smaller and smaller, the speaker used therein is also required to have a low profile with small size.

Generally, a micro-speaker related to the present disclosure electrically connects to external circuits via elastic contacts. Such a micro-speaker includes a frame, a sound generator accommodated in the frame, and contacts positioned by the frame. Generally, the contact is mounted on a lower surface of the frame and includes an elastic arm for connecting with the external circuits. For ensuring the stable connection between the contact and the external circuit, the contact is usually made of metal sheet capable of elastic deformation. Since the contact is fixed to the lower surface of the frame by soldering, a soldering area for the contact should be retained in the lower surface of the frame, which will take up the effective space of the frame and increase the cost of the product.

Accordingly, an improved micro-speaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
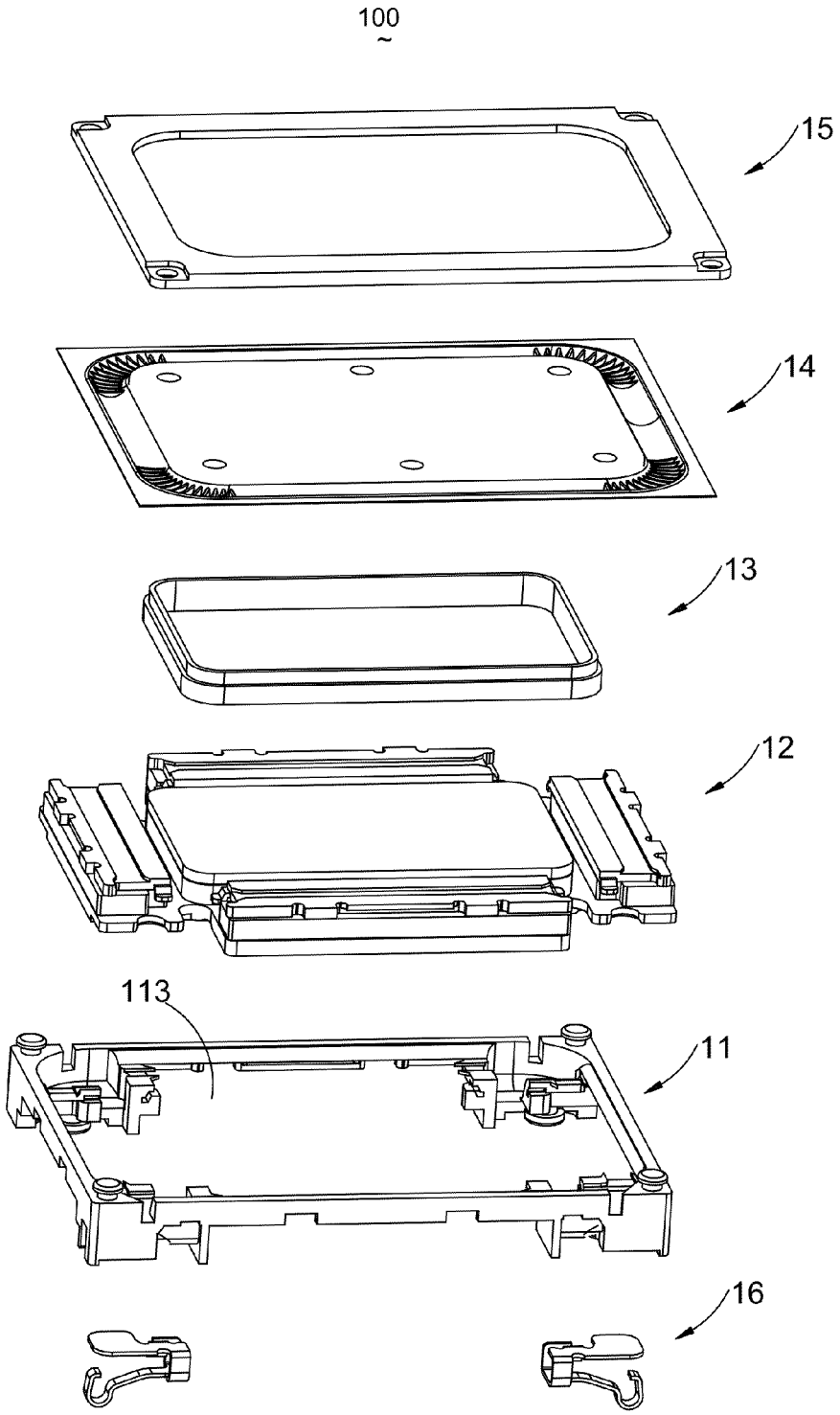
FIG. 1 is an isometric exploded view of a micro-speaker in accordance with an exemplary embodiment of the present disclosure.
Figure 2:
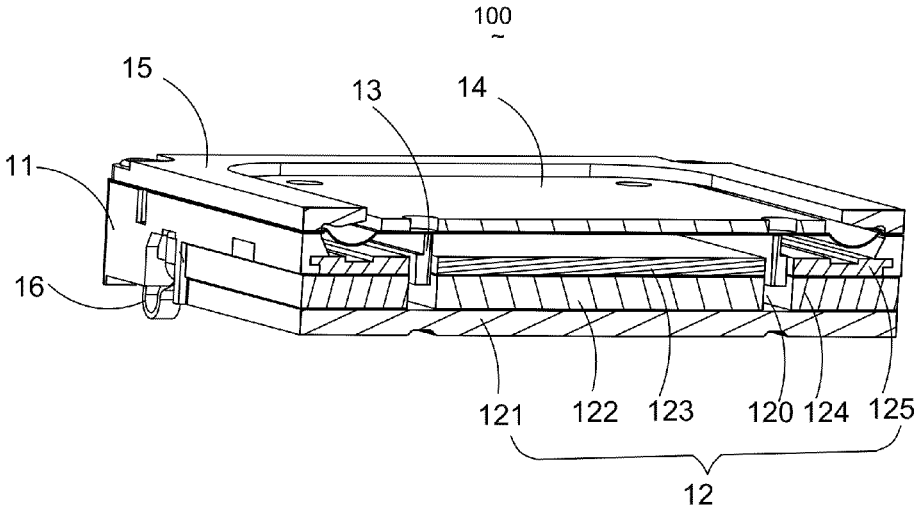
FIG. 2 is a cross-sectional view of the micro-speaker in FIG. 1.
Figure 3:
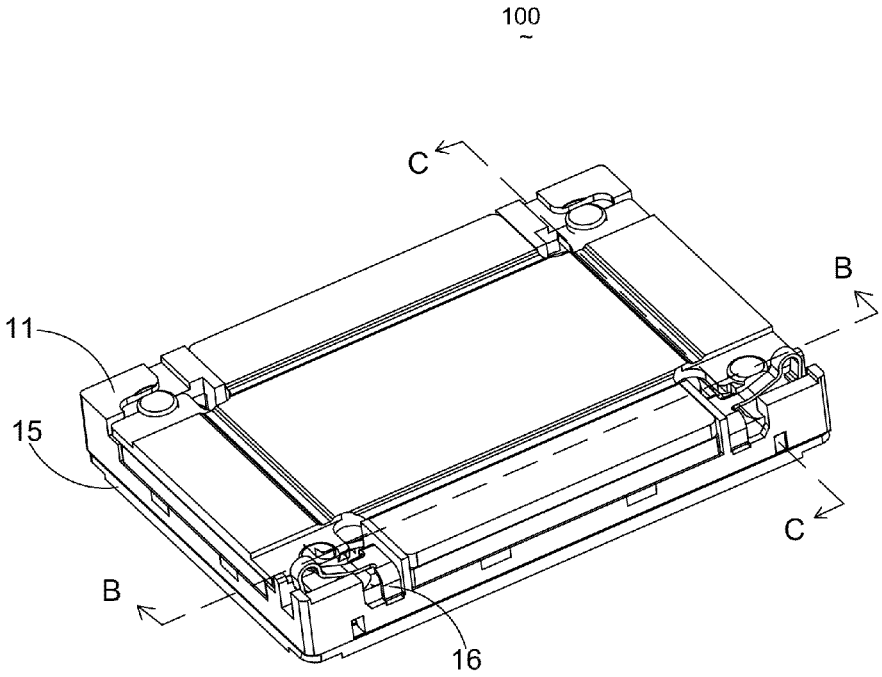
FIG. 3 is an assembled view of the micro-speaker in FIG. 1.

Referring to FIGS. 1-3, a micro-speaker 100 in accordance with an exemplary embodiment of the present disclosure comprises a frame 11 providing a receiving space 113, a magnetic circuit unit 12 accommodated in the receiving space 113, a voice coil 13 electrically connected to an external circuit (not shown), a diaphragm 14 driven by the voice coil 13 for generating audible sounds, and a cover 15 pressing a periphery of the diaphragm 14 for fixing the diaphragm 14 to the frame 11. In addition, the micro-speaker 100 includes a plurality of contacts 16 for electrically connecting the voice coil 13 to the external circuit. In this embodiment, two contacts 16 locates on the frame 11 and keeps a distance from each other.

Referring especially to FIG. 2, the magnetic circuit unit 12 comprises a lower plate 121, a first magnet 122 positioned on a central portion of the lower plate 121, a first pole plate 123 attached on a top of the first magnet 122, a plurality of second magnets 124 positioned on the lower plate 121 separated from the first magnet 122, and a plurality of second pole plates 125 attached on a top of the second magnets 124. While assembled, the second magnets 124 surrounds the first magnet 122 and a magnetic gap 120 is accordingly formed between the first magnet 122 and the second magnets 124 for partially receiving the voice coil 13. When electrified, the voice coil 13 is activated to vibrate due to the Lorenz Force generated by the magnetic circuit 12. Accordingly, the diaphragm 14 is driven by the voice coil 13 to vibrate, and sounds are thus produced and radiated.

Figure 4:
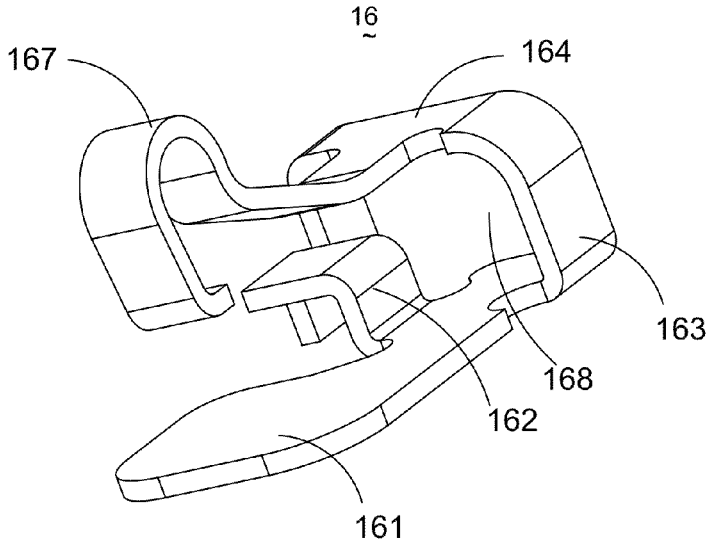
FIG. 4 is an isometric view of a contact used in the micro-speaker in FIG. 1.
Figure 5:
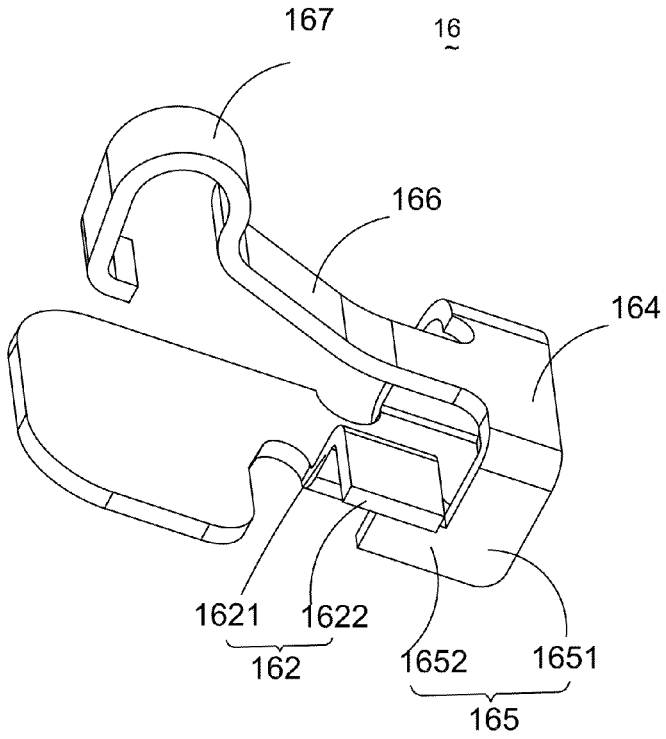
FIG. 5 is an isometric view of the contact in FIG. 4, but from another aspect.
Figure 6:
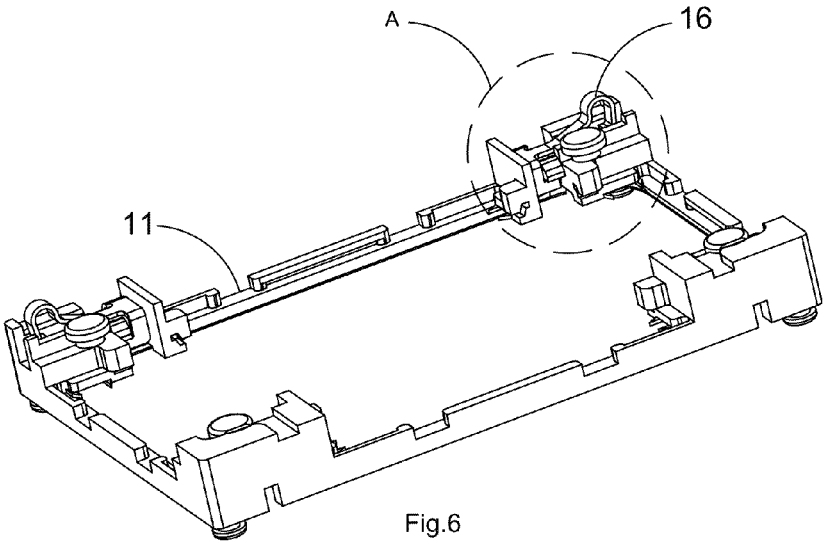
FIG. 6 is an assembled view showing the engagement between the contact and a frame of the micro-speaker.
Figure 7:
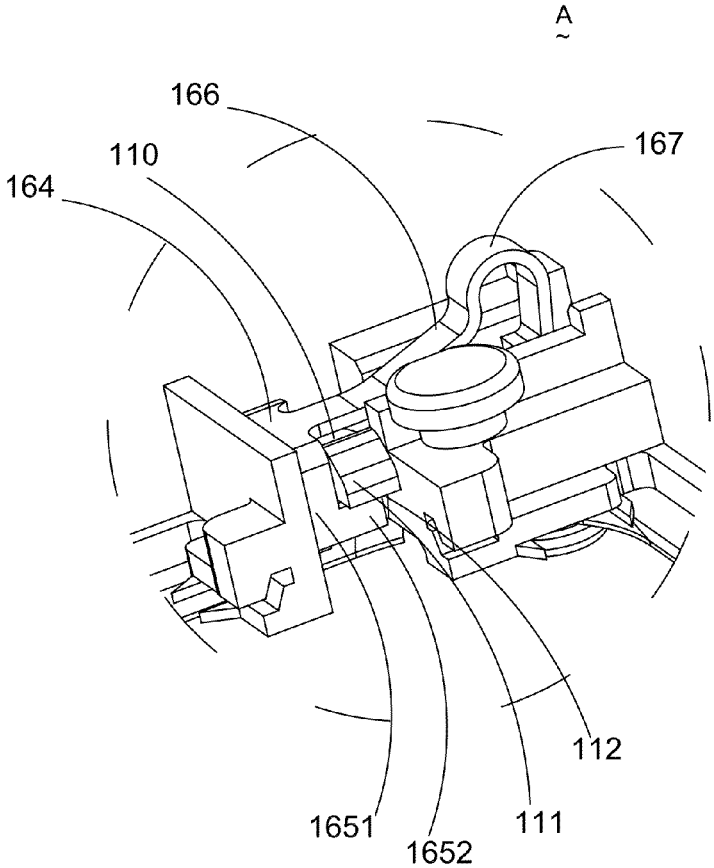
FIG. 7 is an enlarged view of the circled part A in FIG. 6.
Figure 8:
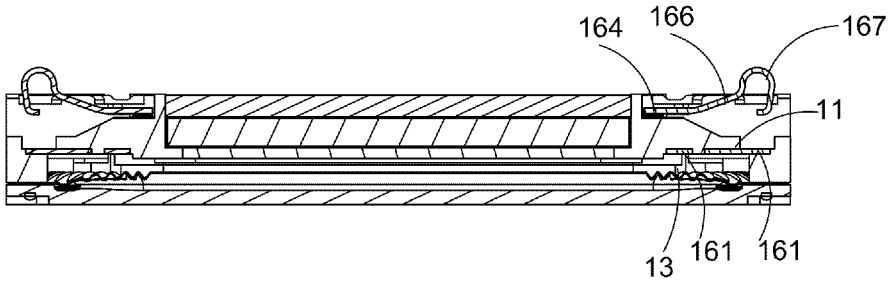
FIG. 8 is a cross-sectional view of the micro-speaker taken along line B-B of FIG. 3.
Figure 9:
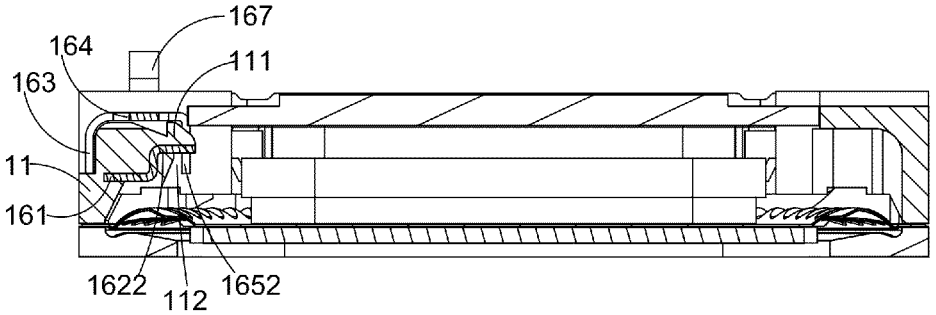
FIG. 9 is a cross-sectional view of the micro-speaker taken along line C-C of FIG. 3.

Referring to FIGS. 4-5, each of the contacts 16 of the micro-speaker is made by stamping and bending a metal plate. The contact 16 includes a base plate 164, a first connecting plate 163 extending upward from one end of the base plate 164, a second connecting plate 165 extending upward from another end of the base plate 164 and parallel to the first connecting plate 163, an elastic arm 166 extending obliquely from a side of the base plate 164, and a contact tip 167 extending obliquely from an end of the elastic arm 166. The elastic arm 166 is located between the two ends of the base plate 164. The first connecting plate 163, the base plate 164 and the second connecting plate 165 are connected in order to form an engaging space 168. Optionally, the first and second connecting plates 163, 165 are perpendicularly to the two ends of the base plate 164 respectively. In this embodiment, the term "upward" means a direction toward the cover 15.

The contact 16 further comprises a soldering pad 161 located in the engaging space 168 (i.e. located between the first and second connecting plates 163, 165) and connected to a distal end of the first connecting plate 163 for electrically connecting with the voice coil 13 and a latch 162 extending obliquely from a side of the soldering pad 161 away from the first connecting plate 163. The soldering pad 161 is substantially perpendicular to the first connecting plate 163. The latch 162 comprises a first portion 1621 extending vertically from a side of the soldering pad 161 away from the first connecting plate 163 and a second portion 1622 extending vertically from an end of the first portion 1621. The second connecting plate 165 comprises a first plate 1651 extending vertically from the end of the base plate 164 and a second plate 1652 extending vertically from an end of the first plate 1651. The second portion 1622 engages with the second plate 1652.

Referring to FIGS. 6-9, while assembled with the frame 11, the contact 16 locates at a periphery of the frame 11. The soldering pad 161 and the latch 162 are insert-molded in the frame 11. A surface of the soldering pad 161 is electrically connected to the voice coil 13.

The frame 11 includes a sidewall 110, a protrusion 111 corresponding to the second connecting plate 165 protruding from the sidewall 110, and a slot 112 formed on the sidewall and below the protrusion 111. The latch 162 is integrated with the protrusion 111 by insert-molding and exposed from a lower surface of the protrusion 111. The sidewall 110 is received in the engaging space 168 and sandwiched between the first connecting plate 163 and the second connecting plate 165. With the configuration of the engaging space, the contact 16 can be mounted on the frame 11 firmly, and there is no need to provide a soldering space in the frame for fixing the contacts and thus the manufacturing cost can be correspondingly reduced. The second plate 1652 is received in the slot 112 and engages with the latch 162. By virtue of the configuration of the first plate 1651 and the second plate 1652, the second connecting plate 165 hooks the protrusion 111 for limiting the upward movement of the elastic arm 166. The soldering pad 161 is located at the periphery of the frame 11 and away from the receiving space 113 of the frame 11, which can prevent the soldering pad from contacting with the lower plate.

When the micro-speaker does not engage with an external component, such as a mother board of a mobile phone, the contact 16 is restricted at an initial position by the engagement of the second connecting plate 165 and the protrusion 111 of the frame 11. Another word, the elastic arm 165 is at a balanced position due to the elastic force generated by the elastic deformation of the elastic arm 166 and an opposite reaction force generated by the engagement between the second plate 1652 and the protrusion 111. When the micro-speaker engages an external component, the elastic arm 166 is forced to deform downwardly by the force from the external component. Due to the force, the elastic arm 166 deforms downwardly, and the second plate 1652 moves downwardly along the slot 112. While the force withdraws, the elastic arm 166 resumes to the initial position and is restricted by the engagement between the second plate 1652 and the protrusion 111. In this embodiment, the contact 16 is made by bending the metal plate to form a structure as above described, thus, the direction of the force generated by the external component is not overlapping with the bending direction of the contact, which can improve the reliability of the contact.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro-speaker, comprising:

a frame providing a receiving space and including a sidewall at a periphery of the frame and a protrusion formed on the sidewall;

a magnetic circuit unit including a magnetic gap and accommodated in the receiving space;

a voice coil partially received in the magnetic gap;

a diaphragm activated by the voice coil for generating sounds and mounted on the frame;

a plurality of contacts fixed by the frame for electrically connecting to the voice coil, each of the contacts comprising a base plate, a first connecting plate extending upward from one end of the base plate, a second connecting plate extending upward from another end of the base plate and engaging with the protrusion, an elastic arm extending from a side of the base plate between two ends of the base plate, and a contacting tip extending from a distal end of the elastic arm;

the first connecting plate, the base plate and the second connecting plate connoted in order for forming an engaging space for receiving the sidewall;

wherein each of the contacts further comprises a soldering pad located in the engaging space and connected to the first connecting plate for electrically connecting to the voice coil.

2. The micro-speaker as described in claim 1, wherein the second connecting plate comprises a first plate extending vertically from the end of the base plate, and a second plate extending perpendicularly from the first plate and engaging with the protrusion.

3. The micro-speaker as described in claim 2, wherein the frame further includes a slot formed on the sidewall and below the protrusion, and the second plate located in the slot.

4. The micro-speaker as described in claim 3, wherein the soldering pad is integrated with the sidewall of the frame.

5. The micro-speaker as described in claim 4, wherein each of the contacts further comprises a latch extending from a side of the soldering pad away from the first connecting plate and integrated with the protrusion for engaging with the second plate.

6. The micro-speaker as described in claim 5, wherein the latch comprises a first portion extending vertically from the side of the soldering pad, and a second portion extending perpendicularly from the first portion and engaging with the second plate of the second connecting plate.

7. The micro-speaker as described in claim 1 further comprising a cover pressing on a periphery of the diaphragm for fixing the diaphragm to the frame.

8. The micro-speaker as described in claim 1, wherein the contact includes a first contact located at one corner of the frame, and a second contact opposed to the first contact.

9. A micro-speaker, comprising:

a frame providing a receiving space, and including a sidewall at a periphery thereof and a protrusion formed on the sidewall;

a magnetic circuit unit accommodated in the receiving space;

a vibrating unit activated by the magnetic circuit unit for generating sounds;

a pair of contacts fixed on the frame and opposite to each other for electrically connecting to the vibrating unit, each of the contacts comprising a base plate, a first connecting plate extending vertically upward from one end of the base plate, a second connecting plate extending vertically upward from another end of the base plate and engaging with the protrusion, an elastic arm extending obliquely from a side of the base plate between two ends of the base plate, a contacting tip extending obliquely from a distal end of the elastic arm; and a soldering pad located between the first connecting plate and the second connecting plate and connected to the first connecting plate perpendicularly for electrically connecting to the vibrating unit;

the first connecting plate, the base plate and the second connecting plate connected in order for forming an engaging space for engaging with the sidewall.

10. The micro-speaker as described in claim 9, wherein the second connecting plate comprises a first plate extending vertically from the end of the base plate, and a second plate extending perpendicularly from the first plate and engaging with the protrusion.

11. The micro-speaker as described in claim 10, wherein the frame further includes a slot formed on the sidewall and below the protrusion, and the second plate located in the slot.

12. The micro-speaker as described in claim 11, wherein the soldering pad is integrated with the sidewall of the frame.

13. The micro-speaker as described in claim 12, wherein each of the contacts further comprises a latch extending from a side of the soldering pad away from the first connecting plate and integrated with the protrusion.

14. The micro-speaker as described in claim 13, wherein the latch comprises a first portion extending vertically from the side of the soldering pad and a second portion extending perpendicularly from the first portion and engaging with the second plate of the second connecting plate.

15. The micro-speaker as described in claim 9 further comprising a cover pressing on a periphery of the vibrating unit for fixing the vibrating unit to the frame.

* * * * *